US005077973A

United States Patent [19]

Suzuki et al.

[11] Patent Number: 5,077,973

[45] Date of Patent: Jan. 7, 1992

[54] APPARATUS FOR CONTROLLING A CONSTRUCTION MACHINE

[75] Inventors: Mitsuru Suzuki; Shuki Akushichi, both of Tokyo, Japan

[73] Assignee: Kabushiki Kaisha Komatsu Seisakuslo

[21] Appl. No.: 474,782

[22] PCT Filed: Jul. 19, 1989

[86] PCT No.: PCT/JP89/00721

§ 371 Date: Mar. 27, 1990

§ 102(e) Date: Mar. 27, 1990

[87] PCT Pub. No.: WO90/01587

PCT Pub. Date: Feb. 22, 1990

[30] Foreign Application Priority Data

Jul. 29, 1988 [JP] Japan ..... 63-190076

[51] Int. Cl.[5] ..... F16D 31/02

[52] U.S. Cl. ..... 60/428; 60/434; 60/368; 60/427; 60/431

[58] Field of Search ..... 60/368, 427, 428, 431, 60/434, 444

[56] References Cited

U.S. PATENT DOCUMENTS

| | | | |
|---|---|---|---|
| 3,927,528 | 12/1975 | van der Kolk et al. | 60/431 |
| 4,369,625 | 1/1983 | Izumi et al. | 60/368 X |
| 4,510,750 | 4/1985 | Izumi et al. | 60/444 X |
| 4,561,250 | 12/1985 | Aoyagi et al. | 60/444 X |
| 4,697,418 | 10/1987 | Okabe et al. | 60/434 |
| 4,712,376 | 12/1987 | Hadank et al. | 60/427 |
| 4,726,186 | 2/1988 | Tatsumi et al. | 60/434 |
| 4,744,218 | 5/1988 | Edwards et al. | 60/368 |
| 4,768,339 | 9/1988 | Aoyagi et al. | 60/427 |
| 4,809,504 | 3/1989 | Izumi et al. | 60/444 X |
| 4,881,450 | 11/1989 | Hirata et al. | 60/427 X |

FOREIGN PATENT DOCUMENTS

| | | |
|---|---|---|
| 0262764 | 7/1987 | European Pat. Off. . |
| 0288314 | 4/1988 | European Pat. Off. . |
| 62-99523 | 5/1987 | Japan . |
| 62-94622 | 10/1987 | Japan . |
| 63-187311 | 8/1988 | Japan . |
| 63-187312 | 8/1988 | Japan . |
| 63-142129 | 10/1988 | Japan . |
| 1223225 | 12/1989 | Japan . |

*Primary Examiner*—Edward K. Look
*Assistant Examiner*—Todd Mattingly
*Attorney, Agent, or Firm*—Welsh & Katz, Ltd.

[57] ABSTRACT

An apparatus for controlling a power shovel or like construction machine which assures that various control modes for performing certain operations can reliably be selected by merely activating a switch corresponding to the operation to be performed. When a certain operation is selected, a CPU and an operation panel inputs a signal indicative of the selected operation into a pump controller. The pump controller outputs a signal indicative of the magnitude of the target engine revolution number and a magnitude of composite suction torque of the pumps adapted to the selected operation to an electric governor controller and a TVC valve. In response to this signal, the governor controller controls a governor and swash plates of the pumps such that the target engine revolution number is reached and the output torque from the engine matches the composite suction torque of the pumps. The pump controller outputs an activating signal to a solenoid between an actuating level and an actuating valve corresponding to the selected operation and outputs a deceleration signal to the electric governor controller corresponding to the selected operation. When the activating signal is outputted to the solenoid, pressurized hydraulic oil discharged from one pump does not deliver to a cylinder. When the deceleration signal is inputted into the electric governor controller and the actuating level is in a neutral position, the governor controller reduces the engine revolutions to a preset lower number.

2 Claims, 16 Drawing Sheets

APPARATUS FOR CONTROLLING A CONSTRUCTION MACHINE

TECHNICAL FIELD

The present invention relates to an apparatus for controlling a construction machine.

BACKGROUND ART

A conventional apparatus for controlling a construction machine is usually constructed such that control mode well adapted to the kind of operation to be performed is selected and instructed by actuating a plurality of switches arranged on an operation panel. The instructed control is executed by the actuation of the switches.

In practice, however, selection and instruction of a certain control mode adapted to the kind of operation being performed by actuation of the plural switches leads to a result that an operator bears a heavy burden. In addition, a control mode is often incorrectly selected, and as the kind of control mode increases, a danger of performing an incorrect operation increases correspondingly. Hence, an object of the present invention is to provide an apparatus for controlling a construction machine wherein the burden to be borne by an operator can be reduced and a danger of incorrectly selecting a control mode can be eliminated reliably.

DISCLOSURE OF THE INVENTION

To accomplish the above object, the present invention provides an apparatus for controlling a construction machine, wherein the apparatus includes operation selecting means for selecting a required operation from a plurality of kinds of basic operations to be performed by the construction machine, and means for selecting and instructing a control mode well adapted to the operation selected by the operation selecting means from the various kinds of control mode, based on the operation selected by the operation selecting means, whereby the content of control mode is well adapted to the automatically selected operation is derived merely by allowing an operator to select a required operation. According to the present invention, certain control modes well adapted to the selected operation are definitely specified. Consequently, the heavy burden to be borne by the operator can be reduced and an operation of incorrectly selecting various kinds of controls can be prevented.

BEST MODE FOR CARRYING OUT THE INVENTION

Now, the present invention will be described in more details hereinafter with reference to the accompanying drawings.

Figure 1:
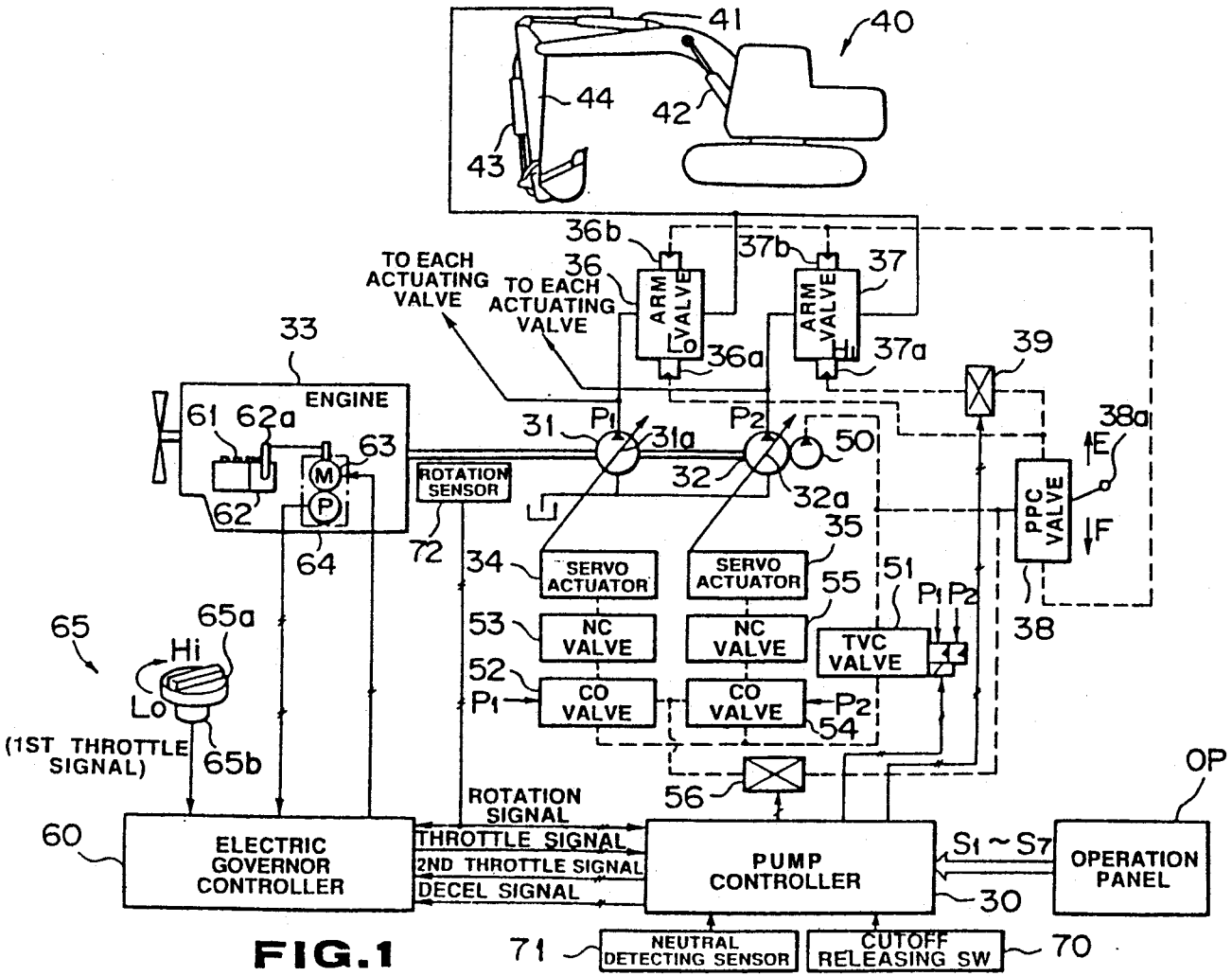
FIG. 1 is a block diagram which schematically illustrates an apparatus for controlling a construction machine in accordance with an embodiment of the present invention.
Figure 2:
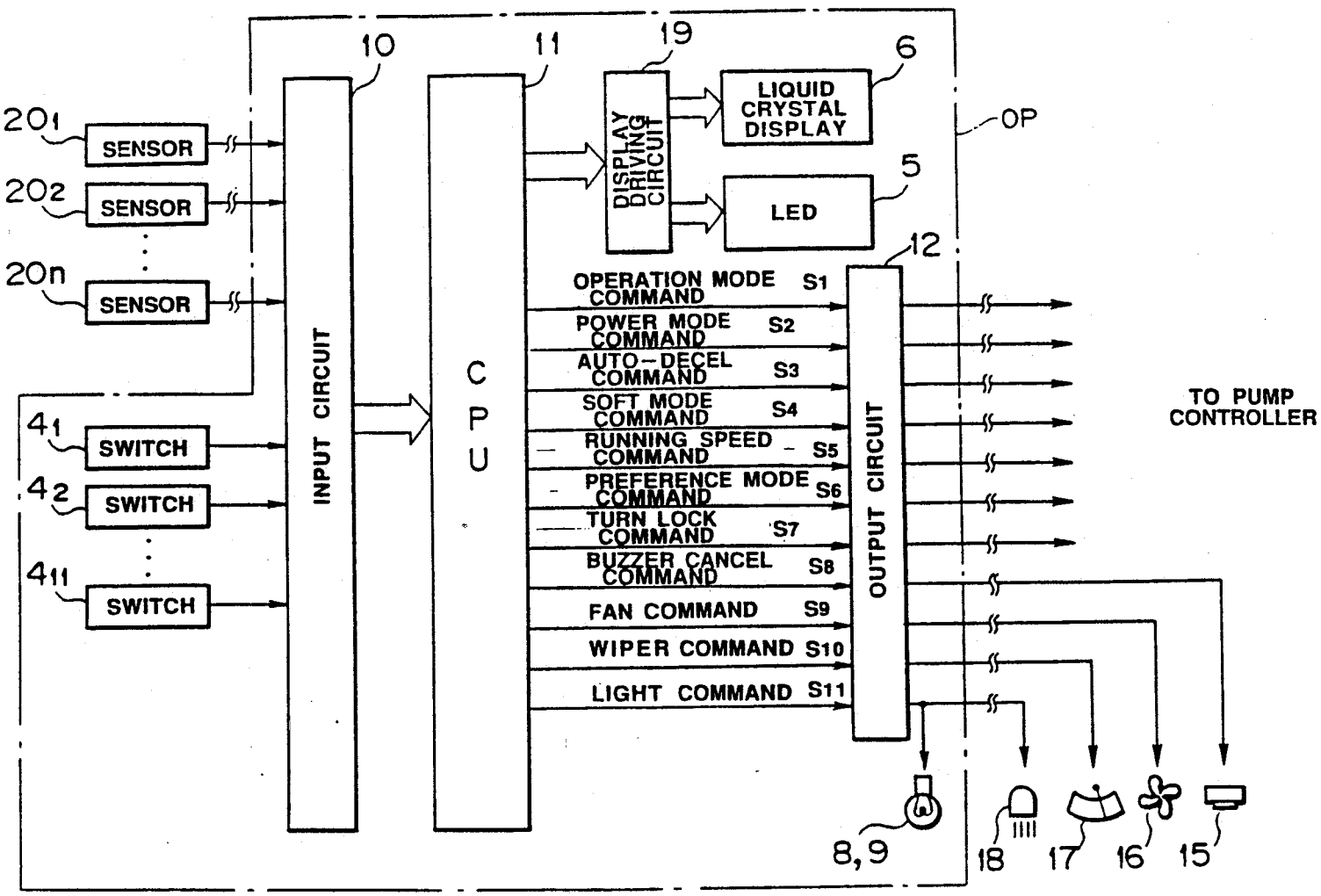
FIG. 2 is a block diagram which schematically illustrates the structure of an operation panel for the apparatus in FIG. 1.

FIG. 1 is a block diagram which schematically illustrates an apparatus for controlling a construction machine in the form of a power shovel 40 in accordance with an embodiment of the present invention. According to the embodiment of the present invention, the apparatus includes an operation panel OP which is constructed as shown in FIG. 2.

Figure 3:
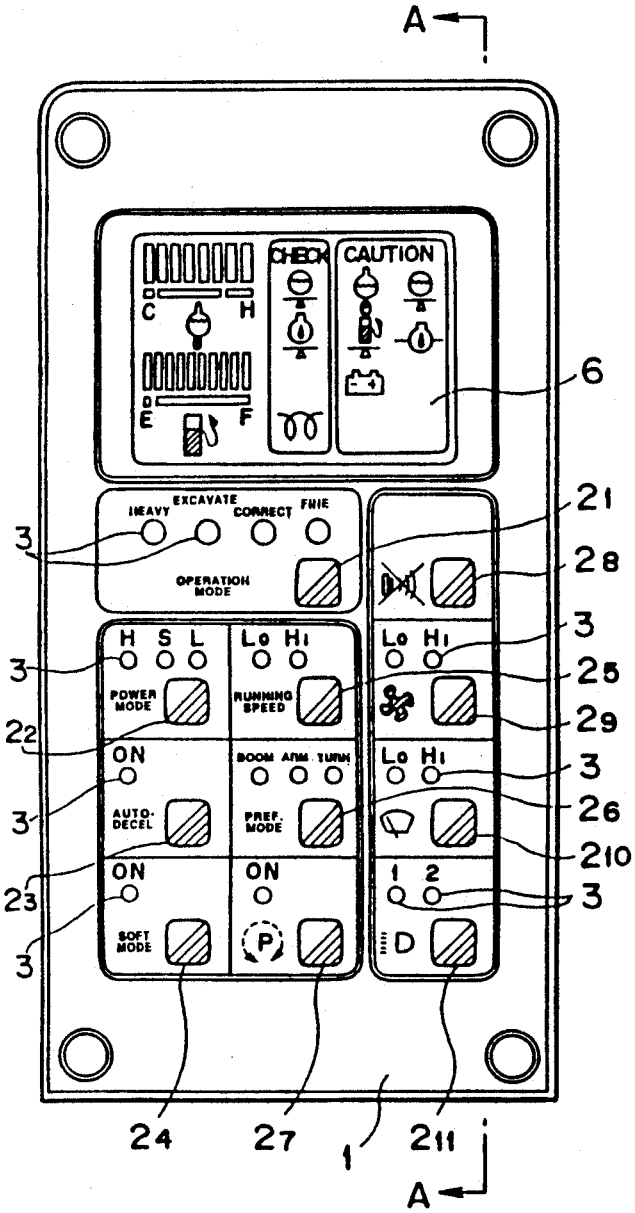
FIG. 3 is a front view of the operation panel in FIG. 2 which shows a panel layout in detail.
Figure 4:
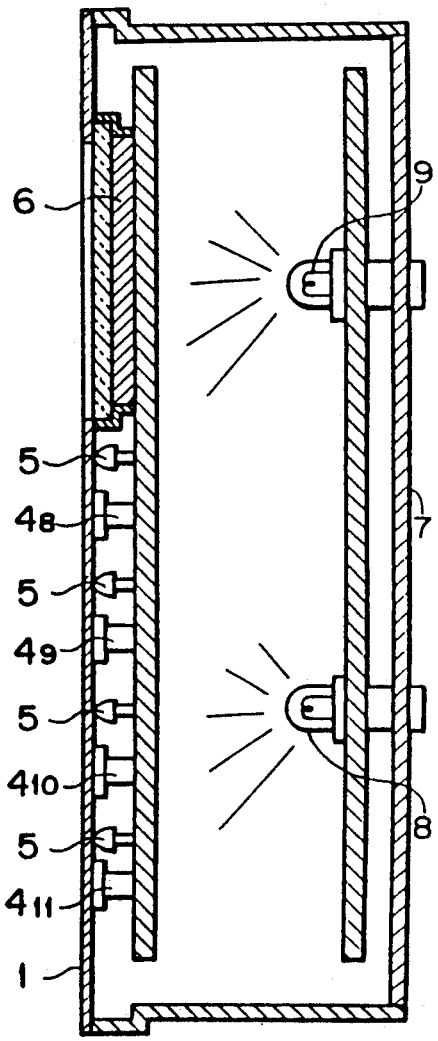
FIG. 4 is a sectional view of the operation panel taken in line A—A in FIG. 3.
Figure 5:
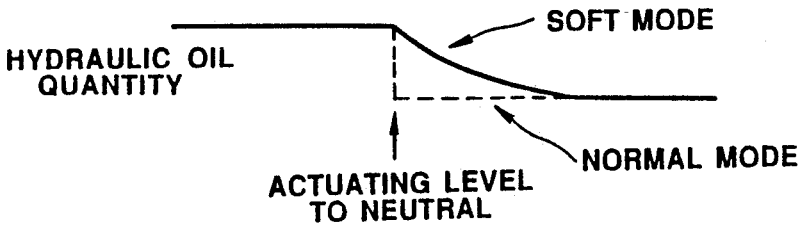
FIG. 5 is an explanatory view illustrating a processing to be performed in a soft mode.

This operation panel OP has a panel layout as shown in FIG. 3. FIG. 4 is a sectional view of the operation panel OP taken in line A—A in FIG. 3. As shown in the drawings, the front surface of the operation panel OP is covered with a flexible sheet 1 made of synthetic resin. This sheet 1 has a light shielding property but a plurality of switch position display marks $2_1$ to $2_{11}$, a plurality of lighting display marks 3, character marks and figure marks arranged in position on the sheet 1 are made transparent.

A plurality of push button switches $4_1$ to $4_{11}$ are arranged on the back side of the sheet 1 at positions corresponding to the marks $2_1$ to $2_{11}$. In addition, a plurality of light emitting diodes 5 are arranged on the back side of the sheet 1 at positions corresponding to the respective marks 3. Further, a liquid crystal display 6 is arranged on the upper part of the operation panel OP.

The operation panel OP includes a casing 7 in which a lamp 8 for lighting the respective transparent marks from the back side of the sheet 1 and a lamp 9 for lighting the liquid crystal display 6 from the back side of the sheet 1 are arranged in position.

The push button switches $4_1$ to $4_{11}$ are of such a type that they are turned on when they are depressed. Thus, they are turned on by depressing locations corresponding to the marks $2_1$ to $2_{11}$ to flex the sheet 1, respectively. The following table 1 shows operation items of the switches $4_1$ to $4_{11}$ and the content of items instructed by the switches $4_1$ to $4_{11}$.

TABLE 1

| switch | operation item | content of instruction |
|---|---|---|
| $4_1$ | operation mode | (A) excavation → fine operation for correction → heavy excavation |
| $4_2$ | power mode | (B) S → L → H |
| $4_3$ | automatic deceleration | (C) OFF → ON |
| $4_4$ | soft mode | (D) OFF → HI |
| $4_5$ | running mode | (E) LO → HI |
| $4_6$ | preference lock | (F) standard → boom arm → turn |
| $4_7$ | turn lock | (G) OFF → ON |
| $4_8$ | buzzer cancel | (H) OFF → ON |
| $4_9$ | fan | (I) OFF → LO → HI |
| $4_{10}$ | wiper | (J) OFF → LO → HI |
| $4_{11}$ | lightening/light | (K) OFF → lighting → lightening/light |

Operation modes "excavation", "correction", "fine operation" and "heavy excavation" shown in the above table represent the kind of basic operations to be performed by the power shovel, respectively. Among them, the operation mode "correction" designates a ground surface leveling operation and the operation mode "fine operation" designates a small quantity of operation to be performed by a work machine.

The power modes "S", "L" and "H" represent a control mode for instructing engine output and a rate of output from hydraulic pumps when the engine output remains at a level of 100. In this connection, it should be added that the rate of output from each hydraulic pump is represented in the form of, e.g., H=100%, L=60% and S=50%.

The automatic deceleration designates a control mode for reducing the present engine revolution number to a preset lower engine revolution number when an operator returns an actuation lever for the work machine to a neutral position.

The soft mode designates a control mode for gradually reducing a flow rate of hydraulic oil to flow through a hydraulic actuator for the work machine without instantaneous interruption of flowing of the hydraulic oil, when the actuation lever is returned to the neutral position.

The preference mode designates a control mode for instructing one of a boom cylinder, an arm cylinder and a motor for turning movement to increase a quantity of hydraulic oil to be fed thereto.

The turn lock represents that an upper turnable assembly of the power shovel is to be locked, and the fan designates a fan for a heater.

A plurality of signals $S_1$ to $S_{11}$ shown in FIG. 2 designate a signal which indicates the content of each of the instructions A to H in Table 1, respectively. These signals are outputted via an output circuit 12. Among the signals $S_1$ to $S_{11}$, the signals $S_8$, $S_9$ and $S_{10}$ are fed to a buzzer 15, a fan 16 and a wiper 17 and the signal $S_{11}$ is fed to the lightening lamps 8 and 9 and other lamps 18 (e.g., front lamp, field work lamp and so on).

The signals $S_1$, $S_2$, $S_6$, $S_9$, $S_{10}$ and $S_{11}$ are prepared in the form of a signal comprising a plurality of bits in structure, respectively. Each signal indicates the content of instruction by combining the respective bits with each other.

FIGS. 6 to 17 are a flowchart which illustrates a series of processings to be executed by a CPU 11 shown in FIG. 2.

When a power supply source is turned on, i.e., when a key switch on the power shovel 40 is shifted to ON, the CPU 11 executes a plurality of processings of initial setting for setting most standard operation modes for the power shovel 40 (step 100). In detail, the CPU 11 executes a processing of setting the content of an operation mode counter to 1 to shift the operation mode to "excavation", a processing of setting the content of a power mode counter to 1 to shift the power mode to "S", a processing of setting an automatic deceleration flag to "H" to shift the automatic deceleration mode to "ON", a processing of setting a soft mode flag to "L" to shift the soft mode to "OFF", a processing of setting a running speed flag to "L" to shift the running speed mode to "LO", a processing of setting the content of a preference mode counter to 0 to shift the preference mode to "standard", a processing of setting a turn lock flag to "L" to shift the content of instructions on the turn lock to "OFF", a processing of setting a buzzer cancel flag to "L" to shift the content of instructions on the buzzer cancel to "OFF", a processing of setting a fan flag to "L" to shift the content of instructions on the fan to "OFF", a processing of setting the content of a wiper counter to 0 to shift the content of instructions on the wiper to "OFF" and a processing of set the content of a lighting/light counter to 0 to set the content of instructions on the lighting/light to "OFF".

After completion of the processings of initial setting, the CPU 11 determines whether the respective push button switches $4_1$, $4_2$, —, $4_{11}$ are shifted to ON or not (steps 101, 102, —, 111). When it is determined at the step 101 that the switch $4_1$ is shifted to ON, the routine goes to the step 102 after the CPU 11 executes a series of processings in the operation mode shown in FIG. 7.

Figure 7:
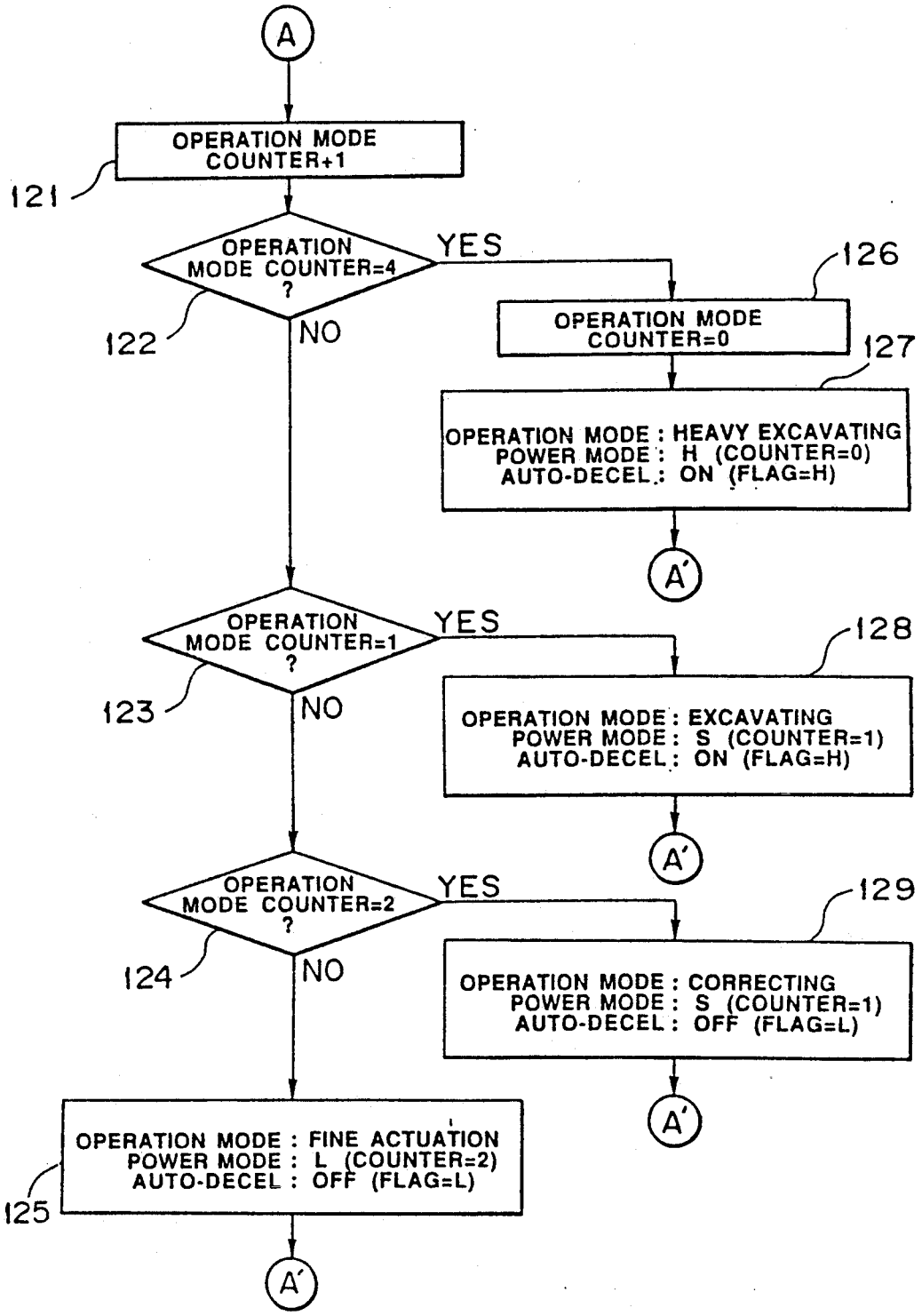

According to the procedure of processings shown in FIG. 7, first, the CPU 11 executes a processing of adding the content of an operation mode counter with 1 (step 121). Then, the CPU 11 determines whether the content of the operation mode counter is set to 4 or not, whether it is set to 1 or not and whether it is set to 2 or not (steps 122, 123 and 124). If it is found that the content of the operation mode counter is not set to any one of 4, 1 and 2, i.e., it is found that the content of the operation mode counter is set to 3, the CPU 11 executes a processing of setting the operation mode to "fine operation", a processing of setting the content of a power mode counter to 2 to shift the power mode to "L" and a processing of setting an automatic deceleration flag to "L" to shift an automatic deceleration mode to "OFF" (step 125).

If it is determined at the step 122 that the content of the operation mode counter is set to 4, the CPU 11 sets the content of the operation mode counter to 0 (step 126) and thereafter executes a processing of setting the operation mode to "heavy excavation", a processing of setting the content of the power mode counter to 0 to shift the power mode to "H" and a processing of setting the automatic deceleration flag to "H" to shift the automatic deceleration mode to "ON" (step 127).

If it is determined at the step 123 that the content of the operation mode counter is set to 1, the CPU 11 executes a processing of setting the operation mode to "excavation", a processing of setting the content of the power mode counter to 1 to shift the power mode to "S" and a processing of setting the automatic deceleration flag to "H" to shift the automatic deceleration mode to "ON" (step 128).

If it is determined at the step 124 that the content of the operation mode counter is set to 2, the CPU 11 executes a processing of setting the operation mode to "correction", a processing of setting the content of the power mode counter to 1 to shift the power mode to "S" and a processing of setting the automatic deceleration flag to "L" to shift the automatic deceleration mode to "OFF" (step 129).

As described above, when the switch $4_1$ is shifted to ON, the CPU 11 sets the power mode and the automatic deceleration mode to the content well adapted to the kind of a operation. It should be added that these modes can arbitrarily be changed by shifting the switches $4_2$ and $4_3$ to ON.

Figure 6:
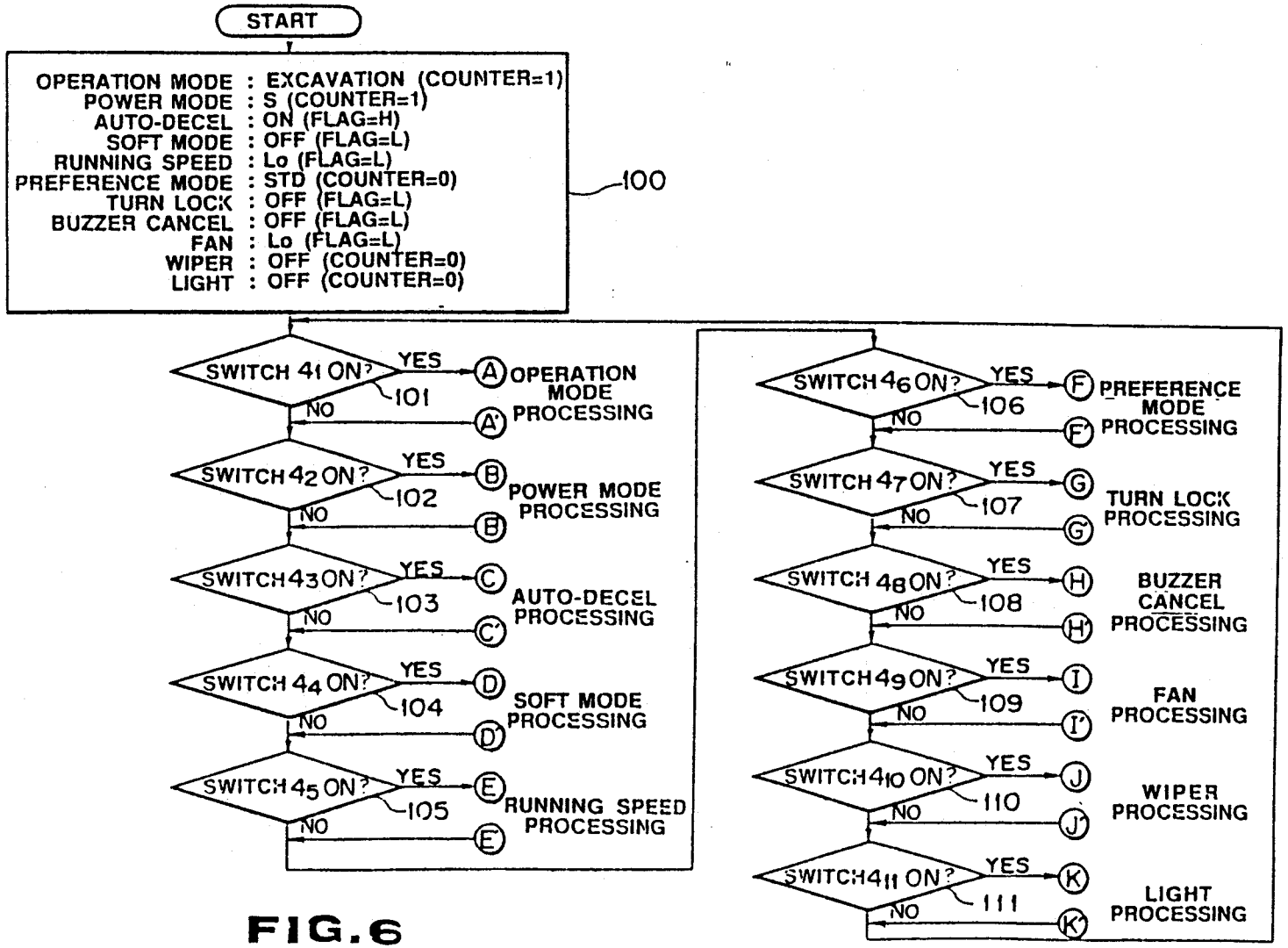
FIGS. 6 to 17 are a flowchart which illustrate a series of steps to be processed by a CPU shown in FIG. 1, respectively.
Figure 8:
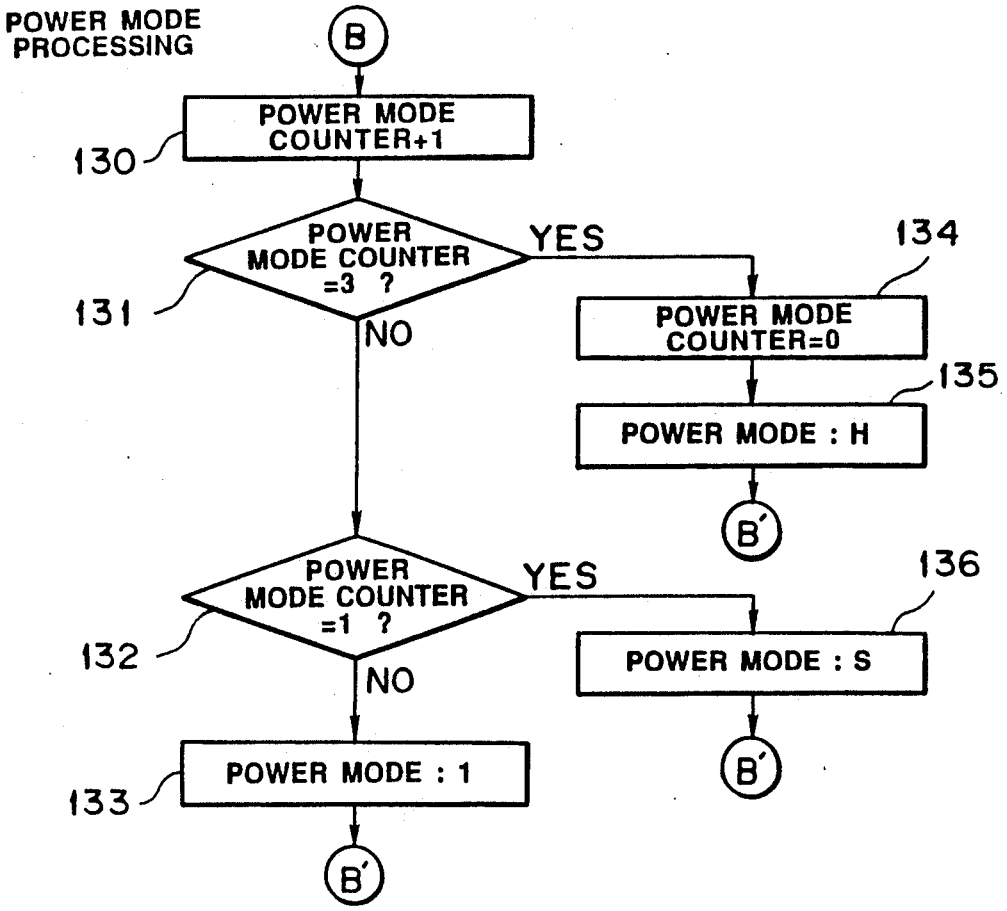

Namely, if it is determined at the step 102 shown in FIG. 6 that the switch $4_2$ is shifted to ON, the CPU 11 increments the content of the power mode counter by 1 (step 130), as shown in FIG. 8. Subsequently, the CPU 11 determines whether the content of the power mode counter is set to 3 or not (steps 131 and 132). It is found that the result derived from each of the determinations at the steps 131 and 132 is NO, i.e., if it is found that the content of the power mode counter is set to 2, the CPU 11 instructs a power mode "L".

If it is determined at the step 131 that the content of the power mode counter is set 3, the CPU 11 sets the content of the power mode counter to 0 (step 134). Thereafter, the CPU 11 instructs a power mode "H". If it is determined at the step 132 that the content of the power mode counter is set to 1, the CPU 11 instructs a power mode "S". According to the aforementioned procedure of processings, the power mode is changed to another one at every time when the power mode switch $4_2$ is actuated.

It should be noted that the power modes "S", "L" and "H" correspond to the contents 1, 2 and 0 of the power mode counter, respectively.

Figure 9:
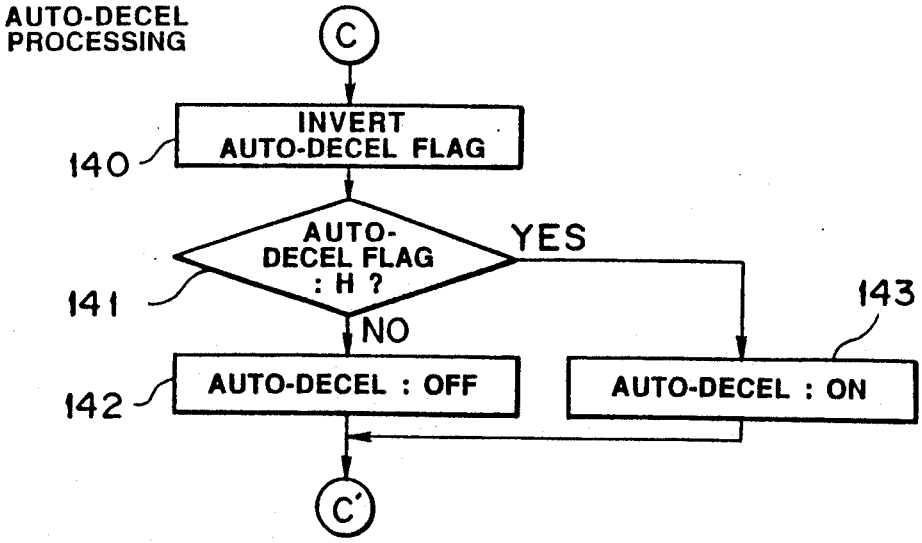

On the other hand, if it is determined at the step 103 shown in FIG. 6 that an automatic deceleration switch $4_3$ is shifted to ON, the CPU 11 inverts the automatic deceleration flag, as shown in FIG. 9 (step 140). Thereafter, the CPU 11 determines whether the automatic deceleration flag is risen to "H" or not (step 141). If it is found that the result derived from the determination at the step 141 that the automatic deceleration flag is not risen to "H", the CPU 11 instructs an automatic deceleration "OFF" (step 142). If it is determined at the step 141 that the automatic deceleration flag is risen to "H", the CPU 11 instructs an automatic deceleration "ON" (step 143).

Therefore, when the switch $4_3$ is shifted to ON, while the automatic deceleration "ON" state is maintained, the CPU 11 instructs an automatic deceleration "OFF". When the switch $4_3$ is shifted to ON, while the automatic deceleration "OFF" state is maintained, the CPU 11 instructs an automatic deceleration "ON".

Figure 10:
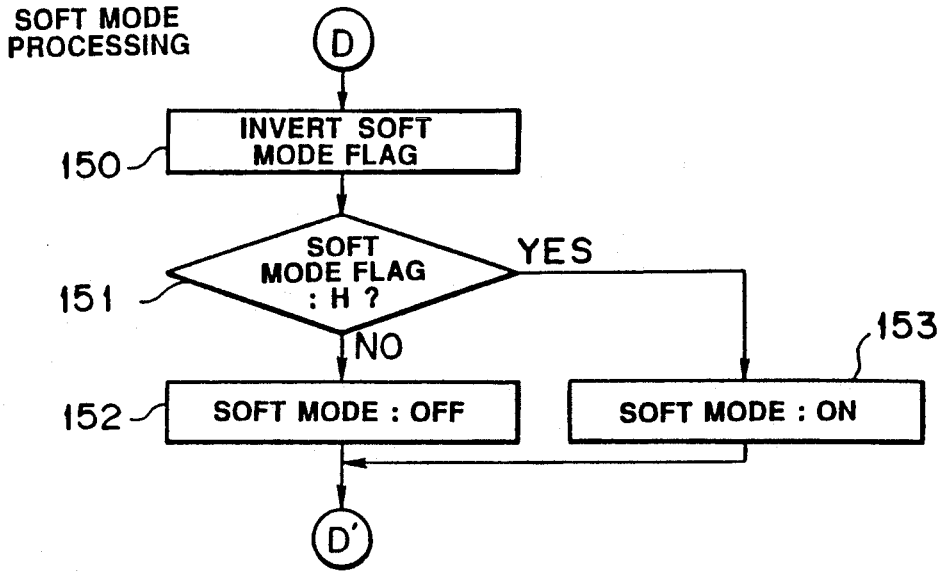
Figure 11:
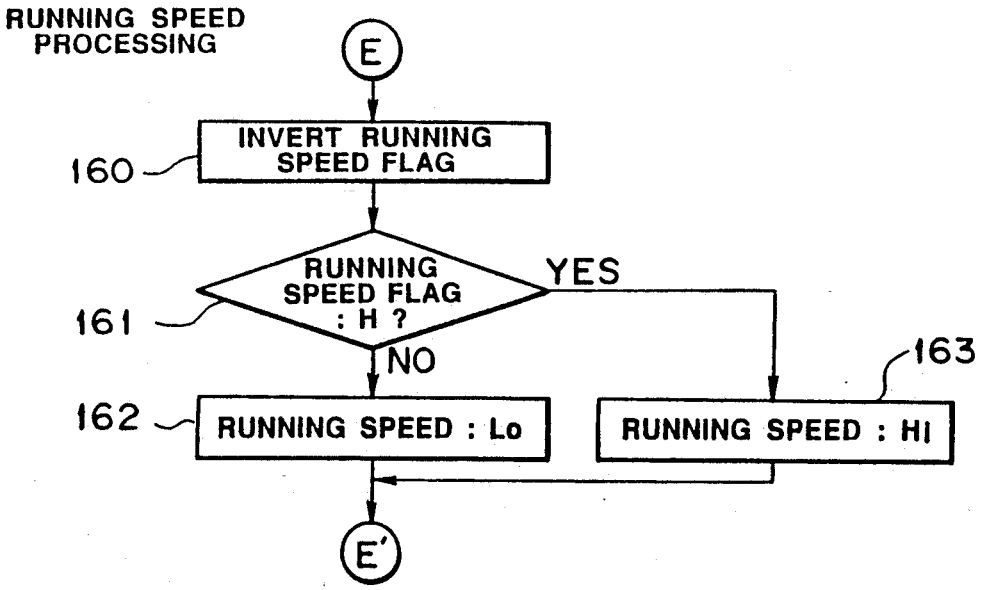

Next, if it is determined at the step 104 in FIG. 6 that the soft mode switch $4_4$ is shifted to ON, the CPU 11 executes a series of steps 150 to 153 similar to the steps 140 to 143 in FIG. 9, as shown in FIG. 10, whereby the soft mode is changed to another one at every time when the switch $4_4$ is shifted to ON.

Figure 12:
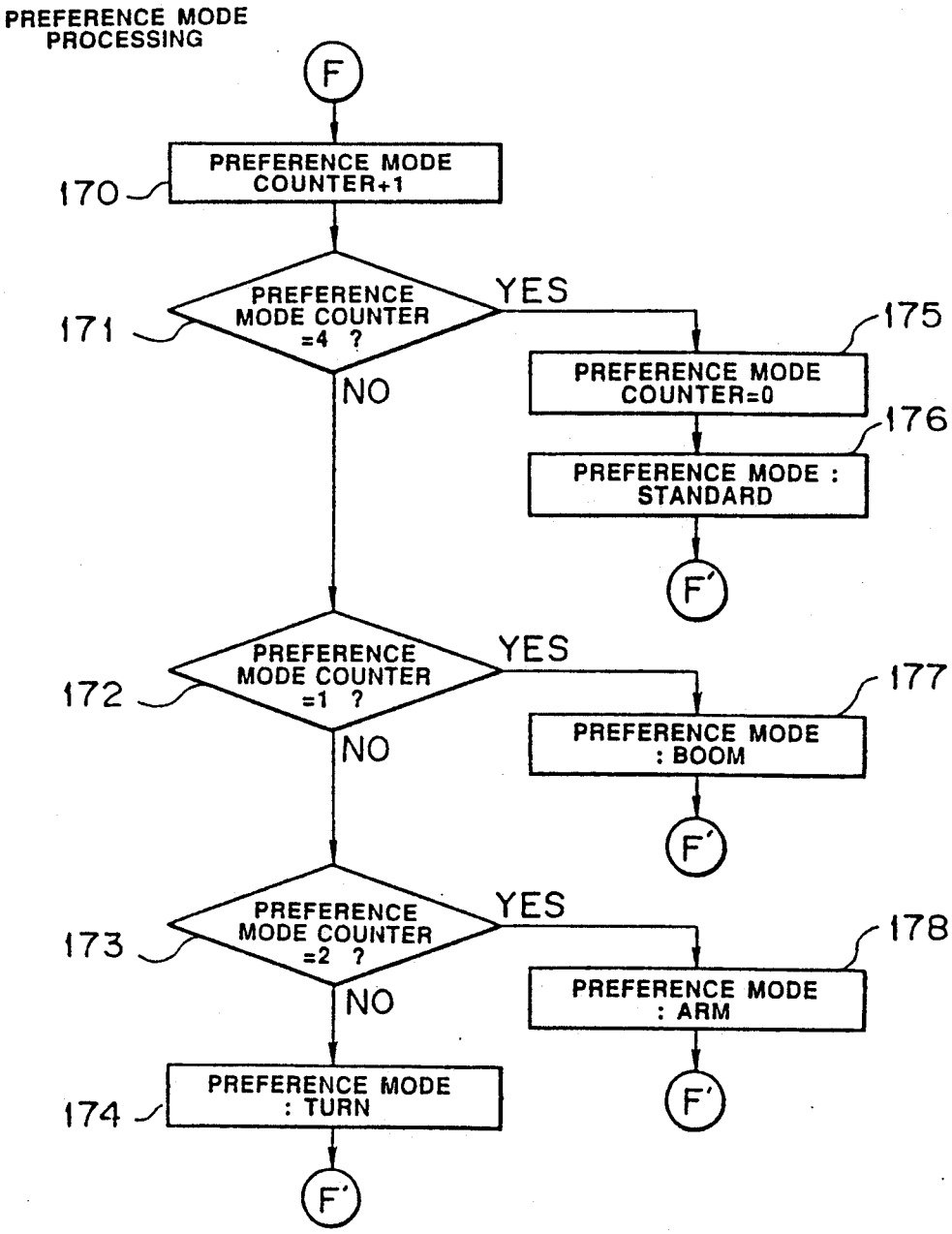
Figure 13:
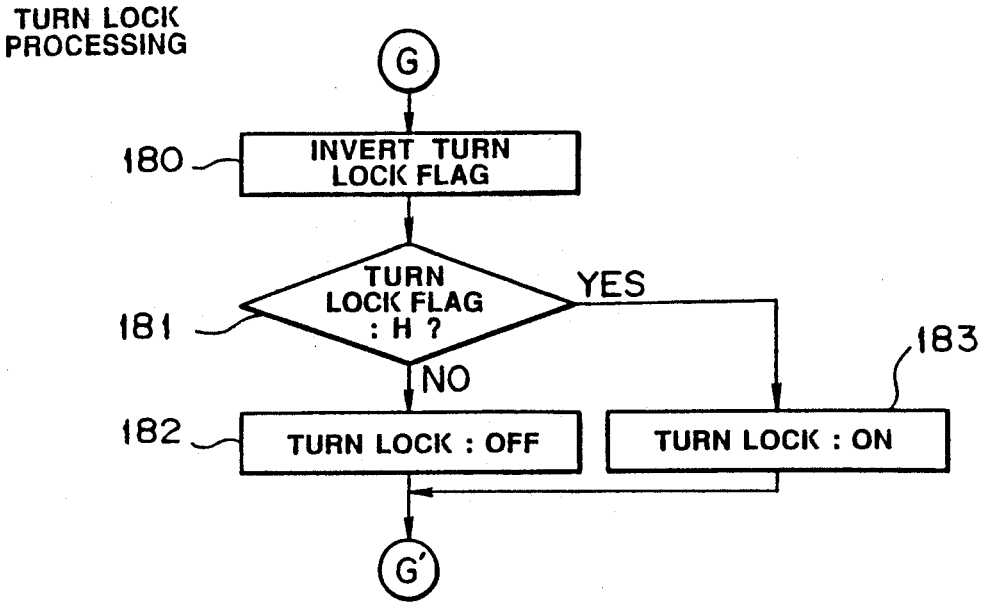

If it is determined at the step 106 shown in FIG. 6 that the preference mode switch $4_6$ is shifted to ON, the CPU 11 adds the content of a preference mode counter with 1, as shown in FIG. 12 (step 170). Subsequently, the CPU 11 determines whether the content of the preference mode counter is set to 4 or not, whether the content of the preference counter is set to 1 or not and whether the content of the preference mode counter is set to 2 or not (steps 171, 172 and 173). If it is found that the result derived from each of these determinations is NO, i.e., if it is found that the content of the preference mode counter is set to 3, the CPU 11 instructs "turn" (step 174).

If it is determined at the step 171 that the content of the preference mode counter is set to 4, the CPU 11 sets the content of the preference mode counter to 0 (step 175). Thereafter, the CPU 11 instructs a preference mode "standard" (step 176). Additionally, if it is determined at the step 172 that the content of the preference mode counter is set to 1, the CPU 11 instructs a preference mode "boom" (step 177). If it is determined at the step 173 that the content of the preference mode counter is set to 2, the CPU 11 instructs a preference mode "arm" (step 178).

As will be apparent from the above description, the preference modes "standard", "boom", "arm" and "turn" correspond to the contents 0, 1, 2 and 3 of the preference mode counter. Thus, the CPU 11 can instruct an arbitrary preference mode by changing the content of the preference mode counter by actuating the switch $4_6$.

Figure 14:
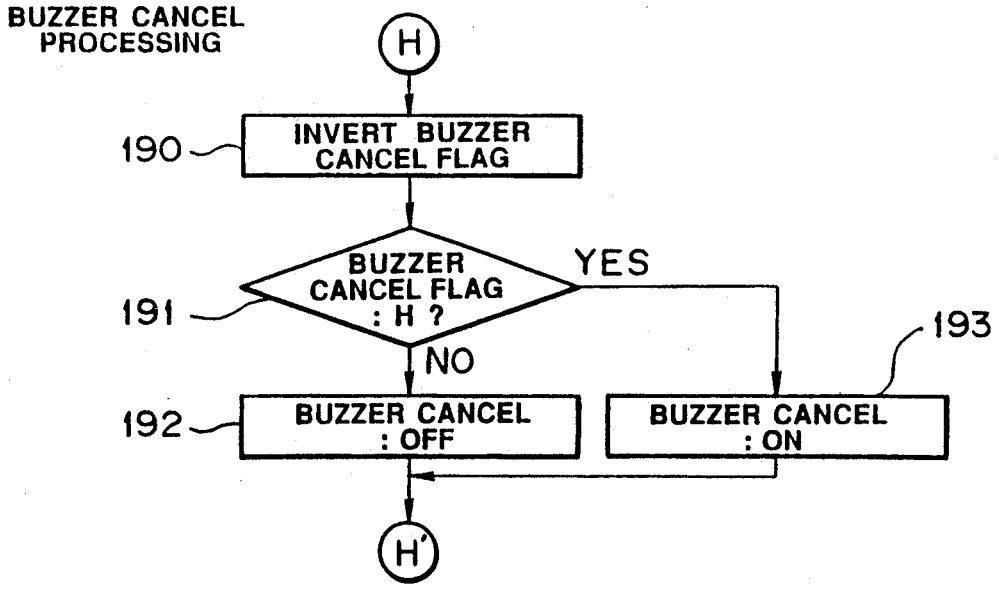

If it is determined at the steps 105, 107 and 108 in FIG. 6 that the running speed switch $4_5$, the turn lock switch $4_7$ and the buzzer cancel switch $4_8$ are shifted to ON, respectively, the CPU 11 executes a series of steps 160 to 163, a series of steps 180 to 183 and a series of steps 190 to 193 similar to the steps 140 to 143 in FIG. 9, as shown in FIG. 14.

Figure 15:
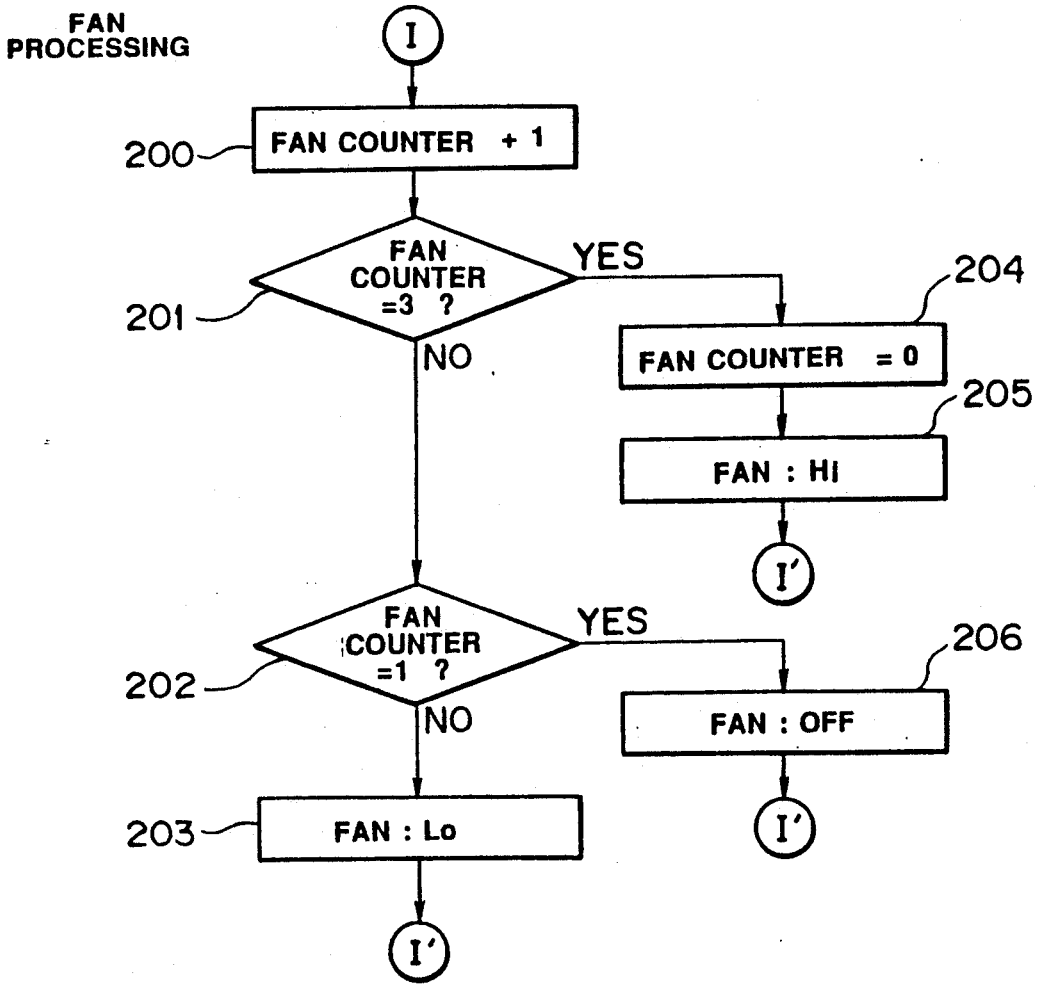
Figure 16:
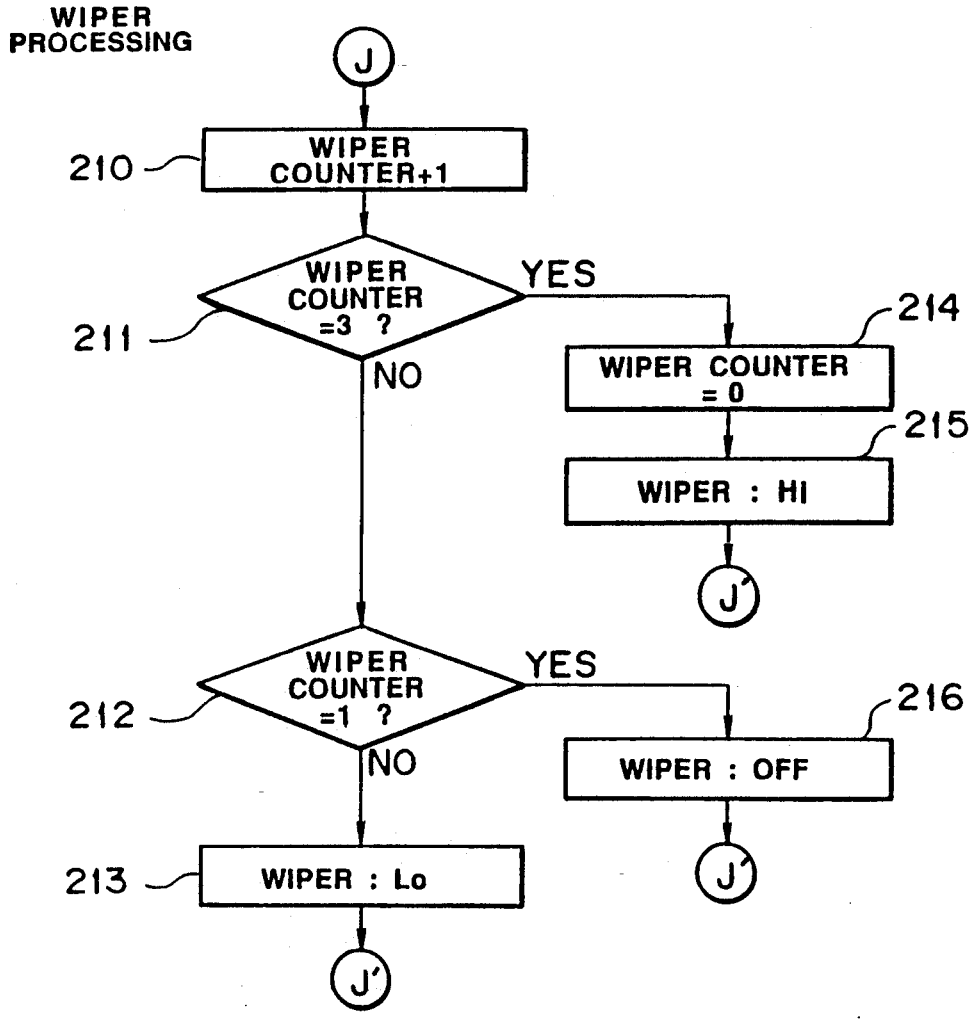
Figure 17:
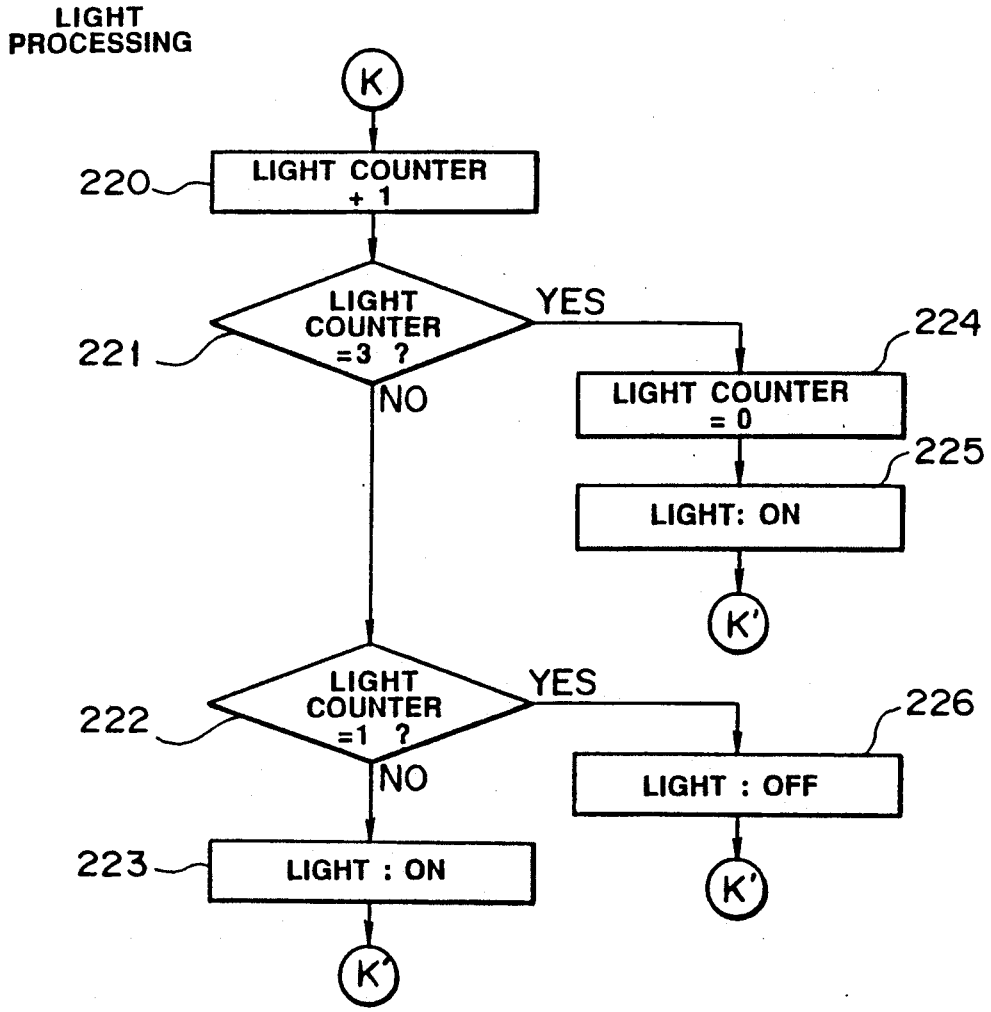

If it is determined at the steps 109, 110 and 111 in FIG. 6 that the fan switch $4_9$, the wiper switch $4_{10}$ and the lightening/light switch $4_{11}$ are shifted to ON, the CPU 11 executes a series of steps S200 to 206, a series of steps 210 to 216 and a series of steps 220 to 226 similar to the steps 130 to 136 in FIG. 8, as shown in FIG. 15, FIG. 16 and FIG. 17.

It should be added that the CPU 11 serves to display results derived from the processing of initial setting shown in FIG. 6 and results derived from the processings shown in FIGS. 7 to 17.

In detail, when the CPU 11 instructs that among the operation modes, e.g., "heavy excavation" is displayed, the light emitting diode 5 located at the location indicative of the character mark (heavy excavation) shown in FIG. 3 is to be turned on via a display driving circuit 19 in FIG. 2. This enables an operator to visually confirm that the present operation mode "heavy excavation" is displayed.

Further, the CPU 11 serves to display results derived from the detections made by a number of sensors $20_1$ to $20_n$ for detecting a temperature of engine coolant, a quantity of fuel, hydraulic pressure in an engine and so forth, on the liquid crystal display 6 via a display driving circuit 19 in response to output signals from the sensors $20_1$ to $20_n$.

Signals $S_1$ to $S_7$ outputted from the operation panel OP are transmitted to a pump controller 30 shown in FIG. 1.

Variable displacement type hydraulic pumps 31 and 32 shown in FIG. 1 are driven by an engine 33, wherein a flow rate of hydraulic oil discharged from the hydraulic pumps 31 and 32 per each revolution is changed by changing a tilt angle of each of their swash plates 31*a* and 32*a* by actuating servo actuators 34 and 35 for driving the swash plates 34 and 35.

Pressurized hydraulic oil discharged from the hydraulic pump 31 is delivered to an arm cylinder 41, a hydraulic motor (not shown) for running the vehicle in the leftward direction, a hydraulic motor (not shown) for turning the vehicle and a boom cylinder 42 via a Lo actuating valve 36 for actuating arms, an actuating valve (not shown) for running the vehicle in the leftward direction, an actuating valve (not shown) for turning the vehicle and a Hi actuating valve (not shown) for a boom.

On the other hand, pressurized hydraulic oil discharged from the hydraulic pump 32 is delivered to an arm cylinder 41, a hydraulic motor (not shown) for running the vehicle in the rightward direction, a bucket cylinder 43 and a boom cylinder 42 via an arm Hi actuating valve 37, an actuating valve (not shown) for running the vehicle in the rightward direction, a bucket actuating valve (not shown) and a boom Lo actuating valve (not shown).

An arm PPC valve 38 is used for feeding pilot hydraulic oil to a pilot port 36*a* in the arm Lo actuating valve 36 and moreover feeding pilot hydraulic oil to a pilot port 37*a* in the arm Hi actuating valve 37 via a normally opened solenoid valve 39, when an actuating lever 38*a* is actuated in the E arrow-marked direction.

When the pilot ports 36*a* and 37*a* are fed with pilot hydraulic oil, the arm Lo actuating valve 36 and the arm Hi actuating valve 37 are actuated to feed a cylinder chamber on the expansion side of the arm cylinder 41 with pressurized hydraulic oil discharged from the hydraulic pumps 31 and 32, whereby an arm 44 is actuated in the rearward direction of a vehicle body.

It should be added that the arm 44 is actuated in the rearward direction of the vehicle body at the time of an excavating operation.

On the other hand, when the actuating lever 38*a* for the PPC valve 38 is actuated in the F arrow-marked direction, pilot hydraulic pressure is fed to a pilot port 36*b* in the arm Lo actuating valve 36 and a pilot port 37*b* in the arm Hi actuating valve 37 so that pressurized hydraulic oil discharged from the hydraulic pumps 31 and 32 is fed to a cylinder chamber on the contraction side of the arm cylinder 41. Consequently, the arm 44 is displaced in the forward direction of the vehicle body. As is well known, the arm 44 is displaced in the forward direction of the vehicle body at the time of a dumping operation.

Incidentally, the actuating valve for running the vehicle and the actuating valve for turning the vehicle are additionally equipped with a separate PPC valve having the same function as that of the PPC valve 38.

The solenoid valve 39 is turned off in response to a signal outputted from the pump controller 30. Since communication between the pilot port 37*a* of the arm Hi actuating valve 37 and the PPC valve 38 is interrupted when the solenoid valve 39 is turned off, pressurized hydraulic oil discharged only from the hydraulic pump 31 is fed to the arm cylinder 41 via the arm Lo actuating valve 36 in response to actuation of the actuating lever 38*a* for the PPC valve 38 in the E arrow-marked direction.

Figure 19:
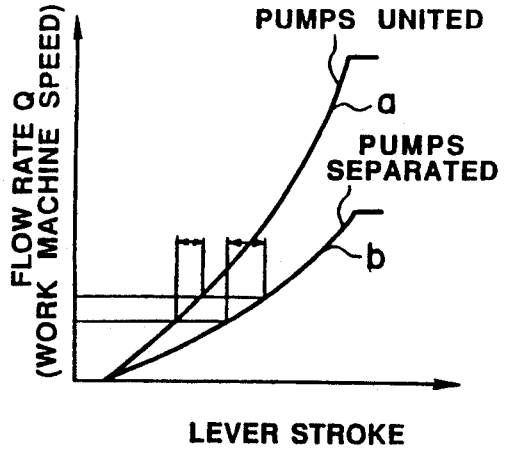
FIG. 19 is an explanatory view illustrating a function of separating hydraulic pumps from each other.

Referring to FIG. 19, characteristic curve and a characteristic curve b represent a relationship between a quantity of stroke of the actuating lever 38*a* for the PPC valve 38 and a flow rate (liter/min) of hydraulic oil discharged from the hydraulic pumps 31 and 32, when the solenoid valve 39 is turned on and off.

As will be apparent from the drawing, in a case where the one hydraulic pump 32 is turned off and pressurized hydraulic oil discharged only from the other hydraulic pump 31 is fed to the arm cylinder 41, a quantity of variation of the lever stroke relative to a quantity of variation of the flow rate is determined large compared with a case where pressurized hydraulic oil discharged from the hydraulic pump 31 and pressurized hydraulic oil discharged from the hydraulic pump 32 are united with each other and fed to the arm cylinder 41.

This means that a fine control function given by the actuating lever 38*a* has been improved. After all, the solenoid valve 39 has a function of separating the hydraulic pump 32 from a hydraulic pressure feed line for the arm 44 when the actuating lever 38*a* is actuated in the E arrow-marked direction.

The pilot hydraulic pressure is fed also to a torque variable control valve (hereinafter referred to as a TVC valve) 51. The pilot hydraulic pressure controlled by the TVC valve 51 is fed to a servo actuator 34 via a CO valve 52 and a NC valve 53 and moreover fed to a servo actuator 35 via a CO valve 54 and a NC valve 55. It should be noted that a hydraulic pressure system including the aforementioned valves 51 to 55 has been heretofore known from, e.g., an official gazette of Japanese Laid-Open Patent No. 81587/1986.

The TVC valve 51 is disposed so as to allow composite suction horse power of the hydraulic pumps 31 and 32 to be kept constant. Specifically, the TVC valve 51 has delivery pressure $P_1$ and delivery pressure $P_2$ from the hydraulic pumps 31 and 32 inputted thereinto so as to control a tilt angle of each of the swash plates 31*a* and 32*a* via servo actuators 34 and 35 such that a product derived from multiplying average pressure $(P_1+P_2)/2$ by a composite delivery oil flow rate Q of the hydraulic pumps 31 and 32 is kept constant, as represented by characteristic curves $A_1$, $A_2$ and $A_3$ in FIGS. 21(*a*), 21(*b*) and 21(*c*), i.e., the above-described composite suction horse power is kept approximately constant.

A characteristic selection signal is transmitted to the TV valve 51 from the controller 30 so that any one of characteristic curves $A_1$, $A_2$ and $A_3$ is selected and set in response to the characteristic selection signal.

The CO valves 52 and 54 have delivery pressure from the hydraulic pumps 31 and 32 inputted thereinto so that when the hydraulic pressure delivered therefrom is in excess of a predetermined cutoff pressure, it is rapidly reduced so as to return the swash plates 31*a* and 32*a* to their minimum position.

Figure 20:
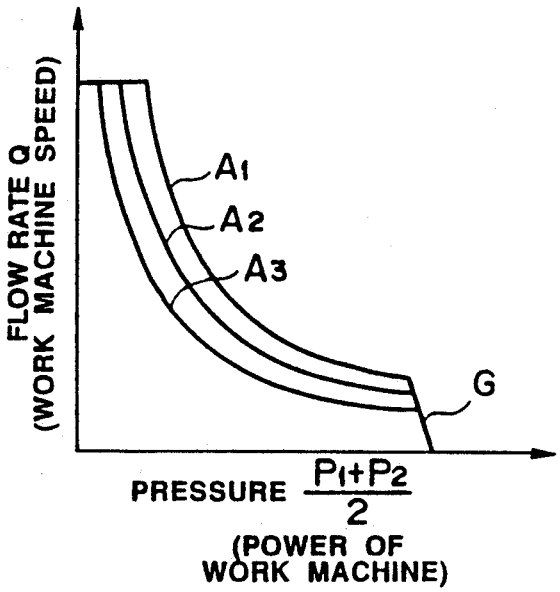
FIG. 20 is a characteristic diagram illustrating a function to be accomplished by a torque variable control valve.

Now, when it is assumed that the hydraulic pumps 31 and 32 is regarded as a single pump, the CO valves 52 and 54 serve to rapidly reduce the flow rate Q of hydraulic oil from the hydraulic pumps 31 and 32 along a cutoff line G, as shown in FIG. 20.

The CO valves 52 and 54 are hydraulically connected to a hydraulic pump 50 via a normally closed solenoid valve 56. As long as the solenoid valve 56 is not activated, the CO valves 52 and 54 perform the aforementioned cutoff operation. When the solenoid valve 56 is turned off in response to an output signal from the controller 30, pilot hydraulic pressure is exerted on the CO valves 52 and 54 so that the aforementioned cutoff function is lost. This makes it possible to elevate the delivery pressure $P_1$ from the hydraulic pump 31 and the delivery pressure $P_2$ to a level of relief pressure of a relief valve (not shown).

When the solenoid valve 56 is to be turned off, an operator actuates a cutoff relief switch 70.

A NC valve 53 serves to reduce output pressure therefrom when all the actuating valves hydraulically connected to the hydraulic pump 31 are displaced to their neutral position.

Specifically, while the respective actuating valves are maintained in the neutral state, a carry-over flow rate is inputted into a jet sensor (not shown) as a signal, causing two pressures each having a pressure difference to appear in the jet sensor. The NC valve 53 has the aforementioned two pressures inputted thereinto so that it serves to reduce output pressure as the pressure difference between them increases.

The reduction of output pressure from the NC valve 53 allows the tilt angle of the swash plate 31*a* to be reduced. Therefore, the NC valve 53 has a function of reducing a flow rate of hydraulic oil discharged from the hydraulic pump 31 when the respective actuating valves are held in their neutral position and thereby preventing energy from being lost.

In addition, a NC valve 55 has the same function as mentioned above relative to the hydraulic pump 32.

The engine 33 shown in FIG. 1 is equipped with a fuel injection pump 61 and a governor 62 which are arranged in a spaced relationship. The governor 62 includes a fuel control lever 62a adapted to be driven by a motor 63 and a driving position of the control lever 62a is detected by a sensor 64.

A throttle quantity setter 65 comprises a dial 65a and a potentiometer 65b to be rotated by the dial 65a. An electric type governor controller 60 compares a first throttle signal outputted from the throttle quantity setter 5 with a second throttle signal outputted from the pump controller 30 so that the motor 63 is driven in response to the smaller signal of the aforementioned signals.

Figure 18:
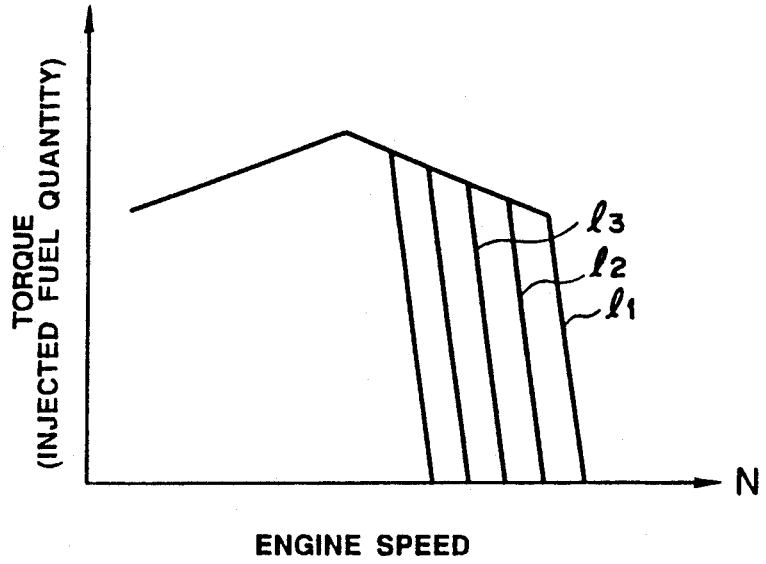
FIG. 18 is a characteristic diagram illustrating a function to be accomplished by a governor.

The governor 62 controls output torque from the engine 33 in accordance with a characteristic curve as exemplified in FIG. 18.

The characteristic curve shown in the drawing includes a regulation line $l_1$ which has been set when a maximum target engine revolution number is instructed in response to a first throttle signal or a second throttle signal, and as the target engine revolution numbers which has been instructed in response to the first throttle signal or the second throttle signal is reduced, another regulation lines $l_2$, $l_3$, —are successively determined. In other words, the governor 62 has a function of serving as a so-called all speed governor.

Next, operations of the apparatus in accordance with the embodiment of the present invention will be described below.

It should be noted that the following description will be made on the assumption that the throttle quantity setter 65 is set to a maximum position.

Table 2 shows main operations to be performed by the apparatus of the present invention.

TABLE 2

| operation mode | power mode | | pumps separated | cutoff | automatic deceleration |
|---|---|---|---|---|---|
| heavy excavation mode | H | PS-H NA | OFF | ON | ON |
| | S | PS-S NA | | | |
| | L | PS-L1 NA | | | |
| excavation mode | H | PS-H NA | OFF | ON | ON |
| | S | PS-S NB | | | |
| | L | PS-Li NB | | | |
| correction mode | H | PS-L1 NA | ON | ON | OFF |
| | S | PS-S NB | | | |
| | L | PS-L1 NB | | | |
| fine operation mode | H | PS-H NA | ON | ON | OFF |
| | S | PS-S NB | | | |
| | L | PS-12 NC | | | |

The CPU 11 instructs any one of the operation modes comprising "heavy excavation", "excavation", "correction" and "fine operation" as mentioned above in response the operation mode signal $S_1$ which has been inputted into the pump controller 30. Now, when it is assumed that the CPU 11 instructs the operation mode "heavy excavation", the CPU 11 sets the content of a power mode signal $S_2$ from the operation panel OP to "H" and moreover it sets the content of an automatic deceleration signal $S_2$ to "H", as described above with respect to the step 127 in FIG. 7.

Then, the controller 30 executes a processing of setting the output horse power from the engine 33 to a high horse power PS-H based on the content "H" of the power mode and a processing of setting the engine revolution number of the engine 33 to a high engine revolution number NA.

Namely, the controller 30 transmits to the TVC valve 51 a signal for setting the constant horse power characteristic curve $A_1$ shown in FIG. 20 and moreover transmits to the governor 60 a second throttle signal indicative of a maximum throttle quantity.

Figure 21A:
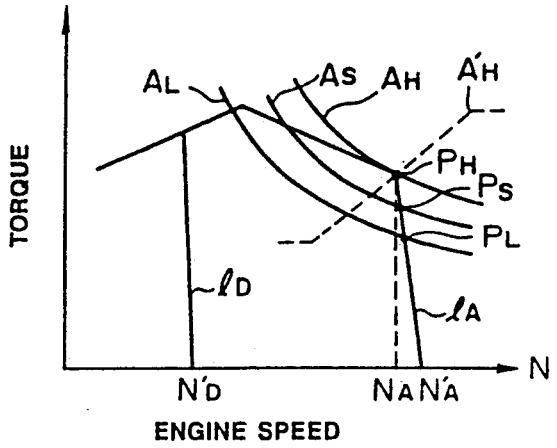
FIG. 21 shows a plurality of characteristic diagrams which illustrate a function to be accomplished out during each operation, respectively.
Figure 21B:
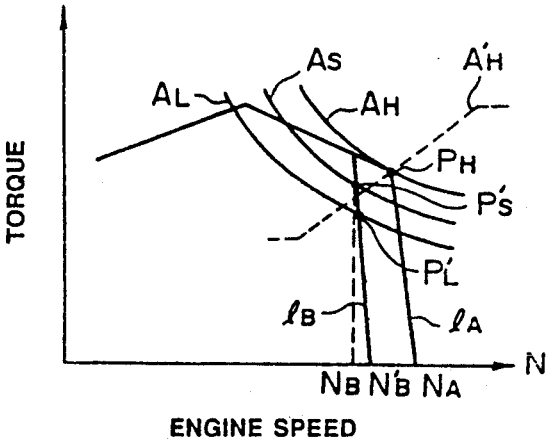
Figure 21C:
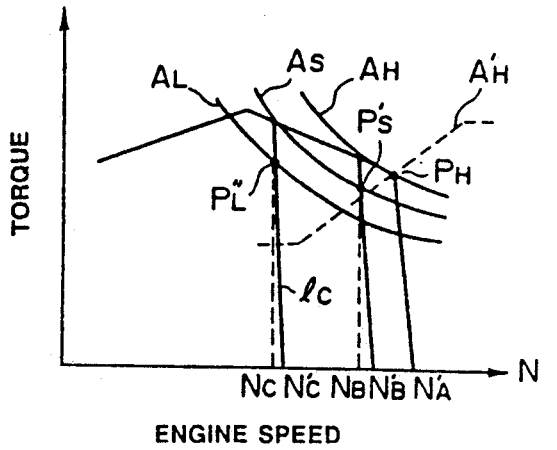

In response to the aforementioned signals, the controller 30 drives the hydraulic pumps 31 and 32 which generate a composite suction torque of which magnitude is determined in accordance with a characteristic curve AH in FIG. 21.

The controller 30 compares the second throttle signal indicative of a maximum target engine revolution number NA' with an output signal from the throttle quantity setter 65.

At this time, the present output signal of the throttle quantity setter 65 is set to a magnitude representative of the maximum target engine revolution NA'. Therefore, in this case, the controller 30 transmits to the governor driving motor 63 a motor driving signal corresponding to the maximum target engine revolution number NA'. This allows the motor 63 to be rotated to actuate the fuel control lever 62a so as to set a highest speed regulation line $l_A$. As a result, the controller 30 carries out control such that the output torque from the engine 33 matches with the composite suction torque generated by the hydraulic pumps 31 and 32 at a point PH (indicative of a maximum horse power point).

In this manner, when the CPU 11 instructs the heavy excavation mode, the output horse power of the engine 33 is automatically set to PS-H (representative of a maximum horse power point) and the engine revolution number is automatically set to NA.

On the other hand, the pump controller 30 transmits a deceleration signal to the governor controller 60 based on the content "ON" of the automatic deceleration signal $S_3$ only when a lever neutral detecting sensor 71 detects that all the actuating levers (only the actuating lever 38a for the arm PPC valve 38 is shown in FIG. 1) are set to their neutral position, i.e., only when the CPU 11 detects that an operation of the power shovel 40 is interrupted.

In response to the deceleration signal, the controller 60 executes a processing of changing the target engine revolution number of the engine 33 from the maximum target revolution number NA' which has been set in response to the second throttle signal to a value ND' shown in FIG. 21(*a*).

Then, the controller 60 drives the governor motor 63 so as to set a regulation line $l_D$ shown in FIG. 21(*a*) with the result that the engine revolution number is reduced substantially.

When the CPU 22 sets the power mode "H" while the heavy excavation mode is maintained, an engine noise and a fuel consumption cost are largely increased with the power shovel 40 held in an inoperative state. To the contrary, since the controller 30 largely reduces the engine revolution number during the inoperative state of the power shovel 40 in response to the deceleration signal, an engine noise and a fuel consumption cost can be reduced, while the power shovel 40 is held in an inoperative state.

When the CPU 22 instructs the heavy excavation mode, the pump controller 30 functions to shift the function of separating hydraulic pumps from each other to "OFF" (refer to Table 2).

Namely, the controller 30 does not output an activating signal to the normally opened solenoid valve 39 but serves to continuously maintain the solenoid valve 39 in the opened state.

In this case, the arm cylinder 41 is driven by pressurized hydraulic oil delivered from the hydraulic pumps 31 and 32, as mentioned above, whereby a properly determined intensity of force is imparted to the cylinder arm 41.

On the other hand, when the CPU 11 instructs the heavy excavation mode, the controller 30 shifts the cutoff operation of the CO valves 52 and 54 to "ON". In other words, the controller 30 does not output an activating signal to the normally closed solenoid 56, whereby the CO valves 52 and 53 perform the aforementioned cutoff operation.

As described above, when the CPU 11 in the operation panel OP instructs a heavy excavation mode, the power mode H suitable for a heavy excavating operation is selected so that horse power to be generated by the engine is automatically set to PS-H and the engine revolution number is automatically set to NA.

In addition, the CPU 11 automatically sets a function of separating hydraulic pumps from each other to "OFF", automatically set a cutoff function to "ON" and automatically set a function of automatic deceleration to "ON".

Items of the above-described functions are represented by description within the range defined by bold lines in Table 2.

Next, description will be made below as to a case where the CPU 11 in the operation panel OP instructs "excavation mode".

In this case, as described above with respect to the step 128 shown in FIG. 7, the CPU 11 in the operation panel OP selects the power mode "S" and moreover selects the automatic deceleration "ON". Then, the controller 30 outputs a signal to the TVC valve 51 to derive the constant horse power characteristic curve $A_2$ shown in FIG. 20 and transmits a second throttle signal to the controller 60 to instruct the target engine revolution number NB'.

Since the engine revolution number NB' is smaller than the engine revolution number NA' set by the setter 65, the controller 60 transmits to the motor 63 a motor driving signal corresponding to the target engine revolution number NB'. In response to the motor driving signal, the governor 62 sets a regulation line $l_B$ shown in FIG. 21(*b*).

Thus, the composite suction torque derived from the hydraulic pumps 31 and 32 matches with the output torque from the engine 33 at a point Ps'. As a result, the engine 33 is rotated with the output horse power PS−S (<PS−H) and the engine revolution number NB.

In other words, the power shovel 40 assumes an operative state suitable for the normal excavation operation.

Incidentally, since the content of instructions on a function of separating hydraulic pumps from each other, a cutoff function and a function of automatic deceleration are same as those at the time of the heavy excavating operation, repeated description will not be required.

The content automatically set when the CPU 11 instructs the heavy excavating mode is represented by description within the range defined by bold lines in Table 2.

When the CPU 11 in the operation panel OP instructs "correction mode", the CPU 11 automatically sets the power mode S having the same content as the power mode S at the time when the excavating mode is instructed and then the CPU 11 executes the same processings as those mentioned above with respect to the TVC valve 51 or the engine 33.

On the other hand, when the CPU 11 instructs "correction mode", the automatic deceleration "OFF" described above with respect to the step 129 in FIG. 7 is set by the CPU 11. Therefore, even when the pump controller 30 detects that e.g., the lever neutral position detecting sensor 71 assumes the neutral state, the CPU 11 does not output a deceleration signal to the governor controller 60.

The reason why the CPU 11 does not perform a decelerating operation at the time of the correction mode is as described in the following. Namely, the work machine actuating lever is frequently restored to the neutral position during the correcting operation. Thus, when the CPU 11 reduces the engine revolution number by executing a processing of deceleration at every time when the actuating lever is restored to its neutral position, a proper operation can not be performed.

On the other hand, when the CPU 11 instructs the correction mode, a function of separating the hydraulic pumps from each other and a cutoff function as represented by description within the range defined by bold lines in Table are set to "ON". Namely, the pump controller 30 transmits an activating signal to the normally opened solenoid valve 39. Then, when the solenoid valve 39 is turned off and then the lever 38*a* for the PPC valve 38 is actuated in the E arrow-marked direction, i.e., when it is actuated in such a direction that the arm cylinder 41 is expanded, pressurized hydraulic oil discharged only from the hydraulic pump 31 is delivered to the arm cylinder 41. Thus, while the arm cylinder 41 is expanded, the other hydraulic pump 32 is hydraulically separated from the cylinder arm 41.

Incidentally, when the actuating lever 38*a* is actuated in the F arrow-marked direction, pressurized hydraulic oil is discharged from the both hydraulic pumps 31 and 32 so that the arm cylinder 41 is contracted and retracted.

After all, a processing of hydraulic pump separation "ON" designates that an operation of displacing the arm 44 in the clockwise direction (i.e., in the direction of excavating operation) is performed by pressurized hydraulic oil discharged from the hydraulic pump 31 and an operation of displacing the arm 44 in the clockwise direction (i.e., in the direction of dumping operation) is performed by composite pressurized hydraulic oil discharged from the two hydraulic pumps 31 and 32. Thus, the aforementioned processing makes it possible to improve an accuracy of leveling the ground surface during the correcting operation without any reduction of a quantity of operation.

Since the hydraulic pump 34 is hydraulically connected to a bucket cylinder 43 via a bucket actuating valve (not shown), after the CPU 11 executes the aforementioned processing of hydraulic pump separation "ON", the arm cylinder 41 is actuated by the hydraulic pump 31 and the bucket cylinder 43 is actuated by the hydraulic pump 32, when the actuating lever 38*a* for the PPC valve 38 is actuated in the E arrow-marked direction.

Consequently, no load interference takes place between the arm cylinder 41 and the bucket cylinder 43, whereby an accuracy of leveling the ground surface during the correcting operation can be improved.

Since the processing of cutoff "ON" has been already described above, repeated description will not be required any more.

When the CPU 11 in the operation panel OP instructs a fine operation mode, it sets the power mode "L", as described above with respect to the step 125 in FIG. 7. Then, the pump controller 30 performs the following processings to derive the power mode "L" shown in the column "fine operation mode" in Table 2.

Specifically, the CPU 11 transmits a signal to the TVC valve 51 to derive the constant horse power characteristic curve $A_3$ in FIG. 20 and thereby the CPU 11 sets a pump suction torque characteristic curve AL shown in FIG. 21(*c*).

On the other hand, the CPU 11 outputs to the governor controller 60 a second throttle signal indicative of the target engine revolution number Nc' so that the controller 60 drives the governor motor 63 so as to set a regulator line $l_c$ shown in FIG. 21(*c*). As a result, the composite suction torque derived from the hydraulic pumps 31 and 32 matches with the output torque from the engine 33 at the point PL", whereby the engine 33 is rotated with the output horse power PS-L2 (<PS-S<PS-H) and the engine revolution number Nc. It should be added that a function of separating hydraulic pump from each other, a cutoff function and a function of automatic deceleration are same as those in the correction mode.

As shown in Table 2, according to the embodiment of the present invention, when the CPU 11 in the operation panel OP instructs each operation mode, a power mode suitable for the operation mode, a function of separating hydraulic pumps from each other, a cutoff function and a function of automatic deceleration are automatically set by the CPU 11. In addition to these functions, it is of course possible that another function, e.g., a soft function, a function of preference, or the like may be added to the content of the aforementioned automatic setting. Further, it is also possible that among the above-described functions, the functions exclusive of the function of separating hydraulic pumps from each other may arbitrarily be set by a manual operation.

Specifically, as shown in FIGS. 8 and 9, the kind of power mode and ON/OFF of automatic deceleration can arbitrarily be selected by a manual operation and the cutoff function can arbitrarily be released by actuating a cutoff releasing switch 70 as shown in FIG. 1. It should be noted that the item PS-L1 (>PS-L2) designates a horse power at the matching point PL in FIG. 21(*b*).

In a case where the pump suction characteristic curve AH shown in FIG. 21 is set by the CPU 11, there is a fear that the pump suction torque matches with the engine torque with much difficulties.

Accordingly, in a case where the pump is driven at the maximum horse point PH, it is preferable that the characteristic curve AH' as exemplified by a dotted line in FIG. 21 is set in place of the characteristic curve AH.

The characteristic curve AH' can not be derived using the TVC valve 51. However, it can be derived, e.g., by way of the following steps.

In detail, pressure $P_1$ in the hydraulic pump 31 and pressure $P_2$ in the hydraulic pump 32 are detected by pressure sensors and then the engine revolution number N of the engine 33 is detected by an engine speed sensor 71. Due to the fact that the characteristic curve $A_H'$ represents a monotonous increase function with the engine revolution number N as a variable, the present tilt angle of each of the swash plates of the pumps 32 and 32 can be obtained in order to derive the pump suction torque corresponding to the characteristic curve $A_H'$ from an average value $(P_1+p_2)/2$ of the pressure $P_1$ and the pressure $P_2$.

Thus, the characteristic curve $A_H'$ can be derived by controlling the swash plates 31*a* and 32*a* so as to allow them to be tilted to the foregoing tilt angle.

Since ON/OFF of the various kinds of functions shown in Table 2 are set in dependence on the kind of a construction machine to which the present invention is applied, the present invention should not be limited only to the content shown in Table 2.

According to the embodiment of the present invention, a single engine revolution number $N_D'$ is set as a deceleration engine speed at the time when the automatic deceleration is shifted to ON. Alternatively, arrangement may be made such that a required deceleration engine speed can be set by using a setter similar to the engine revolution number setter 65 in FIG. 1 or a suitable shift switch.

A cutoff release to be carried out by the cutoff releasing switch 70 is usually required at the time of a heavy excavating operation. Thus, it is possible to allow the controllers 30 and 60 to execute the following processings as long as the switch 70 is depressed.

a. processing of shifting the operation mode to "heavy excavating mode" and shifting the power mode to power mode H of heavy excavating mode", respectively, even though a certain operation mode and a certain power mode have been selected.

b. A processing of changing a normal set pressure for the main relief valve hydraulically connected to the pumps 31 and 32 to another set pressure which is set higher by 10 to 20 $Kg/cm^2$ than the normal set pressure. Naturally, these set pressures are set higher than the cutoff pressure of each of the CO valves 52 and 54.

In this case, a set pressure variable type relief valve is used. This relief valve is shifted by changing pilot pressure active on the relief valve using, e.g., a solenoid valve (not shown) adapted to be controlled by the controller 30. It should of course be understood that a relief valve may be used of which set pressure can be changed directly in response to a certain electrical signal.

c. A processing of automatically restoring all the functions to the operative state prior to actuation of the switch 70 when several seconds (e.g., 7 to 10 seconds) elapse after the switch 70 is continuously depressed.

INDUSTRIAL APPLICABILITY

As will be readily apparent from the above description, the apparatus for controlling a construction machine according to the present invention assures that various kinds of controls suitable for a certain selected operation can definitely be instructed merely by performing a operation of selecting the kind of operation to be performed. Accordingly, the apparatus of the present invention is preferably employable for a construction machine which is required to reliably carry out control suitable for various kinds of works.

We claim:

1. An apparatus for controlling a construction machine including a first and a second variable displacement type hydraulic pump adapted to be driven by an engine and a first and a second operation valve for feeding to a work machine pressurized hydraulic oil corresponding to a quantity of actuation of an actuating lever; each of the first and second operation valves being provided respectively on a first pressurized oil feeding route between the first pump and the work machine and on a second pressurized oil feeding route between the second pump and the work machine, the work machine being driven by the construction machine in accordance with the actuation of the actuating lever, the apparatus comprising:

a first controlling means for controlling a quantity of fuel injected into the engine and a tilt angle of a first and a second swash plates of the first and second pumps respectively, such that an engine revolution number becomes a preset target engine revolution number and an output torque from the engine becomes a preset target output torque, a second controlling means for reducing the engine revolution number to a preset engine revolution number, when the actuating lever is actuated to a neutral position, a third controlling means for carrying out OFF control of one of the actuating valves provided on one of the pressurized oil feeding routes, when the actuating lever is actuated, a control panel including an operation mode selecting switch for selecting a required operation from a plurality of kinds of basic operations to be performed by the construction machine and a memory for storing, in correspondence with the plurality of kinds of basic operations, values of the target engine revolution number and the target output torque being preset for the first controlling means, a first command for instructing whether control of the second controlling means is to be executed and a second command for instructing whether control of the third controlling means is to be executed, and means for reading from the memory a stored content corresponding to a kind of operation selected by the operation mode selecting switch executing control of the first controlling means on the basis of the read-out content and carryout out ON/OFF control for the second and third controlling means, when the operation mode selecting switch is actuated.

2. An apparatus for controlling a construction machine as claimed in claim 1, wherein in addition to the operation mode selecting switch, the operation panel includes a power mode selecting switch for selecting the values of the target engine revolution number and the target output torque both being set in the first controlling means and an automatic deceleration selecting switch for selecting whether control of the second controlling means is to be executed or not, and wherein, regardless of the actuation of the operation mode selecting switch, the control of the first controlling means is executed in accordance with contents selected by the power mode selecting switch and the automatic deceleration selecting switch and ON/OFF control of the second controlling means is executed, when the power mode selecting switch and the automatic deceleration selecting switch are actuated.

* * * * *